US009120218B1

(12) United States Patent
Stehlik

(10) Patent No.: US 9,120,218 B1
(45) Date of Patent: Sep. 1, 2015

(54) STANDUP PADDLE BOARD GRIP HANDLE

(71) Applicant: Robert Arnold Stehlik, Honolulu, HI (US)

(72) Inventor: Robert Arnold Stehlik, Honolulu, HI (US)

( * ) Notice: Subject to any disclaimer, the term of this patent is extended or adjusted under 35 U.S.C. 154(b) by 0 days.

(21) Appl. No.: 14/269,725

(22) Filed: May 5, 2014

(51) Int. Cl.
*B25G 1/10* (2006.01)
*B63B 35/85* (2006.01)

(52) U.S. Cl.
CPC .. *B25G 1/10* (2013.01); *B63B 35/85* (2013.01)

(58) Field of Classification Search
USPC ..... 16/110.1, 111.1, 422, 430, 431, 436, 16/DIG. 24; 441/65, 74
See application file for complete search history.

(56) References Cited

U.S. PATENT DOCUMENTS

| | | | | |
|---|---|---|---|---|
| 4,153,314 | A * | 5/1979 | Prater | 312/348.6 |
| 4,744,126 | A * | 5/1988 | Bisbing | 16/443 |
| 5,782,325 | A * | 7/1998 | O'Shea et al. | 190/18 A |
| 6,857,673 | B2 * | 2/2005 | Lang | 294/142 |
| 8,777,683 | B2 * | 7/2014 | Friedman | 441/74 |
| 2002/0050725 | A1 * | 5/2002 | Lang | 294/142 |
| 2014/0004762 | A1 * | 1/2014 | Smith | 441/74 |

* cited by examiner

*Primary Examiner* — William Miller
(74) *Attorney, Agent, or Firm* — Usha S. Koshy

(57) ABSTRACT

A standup paddle board grip handle mounted flush on the board for quickly and easily carrying the board. The absence of moving parts on the handle prevents it from malfunctioning due to clogging by sand, salt, or other debris and helps to keep the handle clean and functional at all times. The molded rubber grip surface provides comfort when gripping the handle to carry the board and prevents it from slipping from the hand even when it is wet. The ergonomic design of the grip handle makes it possible for it to be integrated into other boards including even hollow construction water craft using any surface mounted application where the extended flange on the top part of the grip handle sits on top of the surface skin of the craft. The voids on the grip handle allow for the passage of a lock cable to secure the board.

11 Claims, 8 Drawing Sheets

STANDUP PADDLE BOARD GRIP HANDLE

FIELD OF THE INVENTION

The present invention is generally related to handles for carrying water-sport related equipment such as surf boards, paddle boards, body boards and other water craft. More particularly, the invention relates to a grip handle to carry a stand up paddle board.

BACKGROUND OF THE INVENTION

Riding the wave using a surf board or other flotation device has been popular among many water sport enthusiasts for ages. However, more recently, a variation of surf boarding known as stand up paddle surfing or stand up paddle boarding (SUP) has gained in popularity among water sport aficionados' due to its ease of use in riding waves and navigating longer distances on the water surface as compared to the traditional surf boards. Whereas, the surf board can be ridden in a crouching or semi-crouching position, the SUP board is meant to be ridden in a standing posture. Consequently, the SUP boards are generally constructed with a wider and longer body and are therefore, much heavier than the slimmer and lightweight, surf boards.

Traditionally, surf boards, paddle boards, body boards and other such flotation devices which are generally categorized as 'watercraft' were constructed from the wood of local trees in Hawaii where these water sports originated and were much heavier to carry than their modern day counterparts which are predominantly constructed using lighter woods such as, Balsa® wood or synthetic materials primarily, polystyrene or polyester foam, covered with layers of fiberglass and epoxy resin for reinforcement. Regardless of the type of material used for the construction of these watercraft, the traditional surf boards and body boards have a narrow body, making it possible for them to be carried under an arm and wrapping the fingers around the opposite rail of the board. This mode of carrying is not possible with the wider-bodied stand up paddle (SUP) boards and other wide-bodied water craft because they are too wide to fit under an arm. Consequently, these watercraft boards have to be carried by hoisting them onto the shoulder or over the head making the task of carrying them more cumbersome, with the potential for back and shoulder injuries. Therefore, there is a need in the art to find an ergonomic carry handle for these wide-bodied watercraft, one which will allow these boards to be carried under the arm effortlessly and comfortably by even women and children without causing injury to the back, shoulders and other parts of the body. Such an ergonomic carry handle for a stand up paddle (SUP) board and other wide-bodied watercraft will also open up the sport of SUP boarding and other wide-bodied water craft sports to a wider audience and make them more appealing to the masses.

Some prior art have attempted to address the issue of providing a means to carry a surf board as in U.S. Pat. No. 5,094,344 to Savage and U.S. Pat. No. 5,823,551 to Conroy. However, these board carriers require the use of a carry bag for transporting the surf boards. U.S. Pat. Appl. Pub. No. 2010/0187274 describes a stand up surf board carrier with hooks to fit around a surf board side edge and a shoulder strap to place over the shoulder of a user. Such a board carrier would require finding a place to store the board carrier itself when the board is in use. U.S. Pat. Appl. Pub. No. 2013/0130578 describes a retractable handle for a water craft that requires lifting up the retracted handle using fingers and keeping the handle lifted up and held by fingers to carry the water craft, A major shortcoming of this handle is the potential for its moving parts to get clogged with sand and salt from the ocean water or other debris, leading to the handle getting stuck, un-retractable and malfunctioning.

The present invention of an ergonomic, comfortable and easy to use grip handle for a stand up paddle (SUP) board which can also advantageously be used with a surf board and other similar watercraft boards, overcomes the deficiencies in the above prior art for a carry handle for a water sport board as will become obvious from the embodiment and aspects of the invention described through the summary of the invention and detailed description of the invention, in conjunction with the accompanying drawings.

SUMMARY OF THE INVENTION

The present invention is directed to a grip handle for stand up paddle boards as well as other wide-bodied water-craft boards such as, large surf boards and body boards including, sit on top kayaks, small sail boats, windsurf boards, balance training boards, or any boards that are too wide to be carried under the arm and which may benefit from having an ergonomic and comfortable handle integrated into the body of the board to assist in physically carrying the boards to the water's edge to ride the waves, or transporting the boards from location to location as needed. The grip handle of the present invention may also advantageously be used on narrow water sport boards to carry them.

The primary object of the present invention is to provide a sturdy, non-slip, grip handle on a stand up paddle board or other water sport related boards to enable the user to quickly and easily grasp the handle and carry the board to the water's edge when needed as when participating in a paddle board, surf board, or body board racing.

Yet another principle object of the present invention is to provide a handle for a stand up paddle board that does not have any moving parts so that sand, salt, or other debris don't get into the crevices of those moving parts causing the handle to get stuck or corroded, resulting in the handle being inoperable. The grip handle of the present invention has no moving parts and therefore circumvents the problems associated with handles that have to be pulled up as in U.S. Pat. Appl. Pub. No. 2013/0130578 or other board handles that have moving parts which have the potential to get stuck and malfunction due to sand, salt, or other debris entering and clogging those moving parts.

A further object of the present invention is to provide a handle for a stand up paddle board or other water craft board that can be installed flush on the board with no parts of the handle protruding out of the board to cause injury to the user of the board. In addition, the absence of protruding parts on a board handle makes for easy stacking of boards for storage and transport.

In the exemplary embodiment of the present invention, the grip handle structure is constructed from a strong plastic material, preferably Nylon® fiber and installed flush into the deck of the paddle board or other board at the center of gravity of the board to provide the proper balance when the board is carried using the grip handle. In this embodiment, the bottom surface of the center grip handle part of the structure is covered with a molded rubber grip surface preferably made of silica gel that makes the handle comfortable to hold and prevents it from slipping from the hand even when the grip handle is wet.

In other embodiments of the present invention, the grip handle may have additional features added to it to enhance its basic structure in order to provide a more comfortable grip.

In this summary of the present invention describing the various objects and embodiments of the invention and in the specification in general, references to the "exemplary embodiment or "other embodiments" do not necessarily refer to the same embodiment(s). Rather, the references to the various embodiments mean that a particular feature, structure, or characteristics described in conjunction with a specific embodiment is included in at least some embodiments, but not necessarily all embodiments of the invention. The objects, embodiments and features of the board grip handle of the present invention as described in this summary of the invention will be further appreciated and will become obvious to one skilled in the art when viewed in conjunction with the drawings, detailed description of the invention and the appended claims.

DETAILED DESCRIPTION OF THE INVENTION

The present invention is a grip handle for a stand up paddle board or any water sport board having a wide body that allows the board to be easily transported under the arm from one location to another, more particularly from where the board is stored to the water's edge to launch the board for paddling or other water sport. The ergonomic handle of the present invention with the nonslip grip makes it especially useful when the need arises to quickly grab the paddle board for racing and shore break. Additionally, the absence of any moving parts on the handle prevents it from malfunctioning due to the parts getting clogged or corroded by sand, salt, or other debris and helps to keep the handle clean and functional at all times. The grip handle of the present invention can also be integrated into narrow bodied surf boards and other narrow bodied water craft boards to carry those boards to the water or from location to location.

Figure 1:
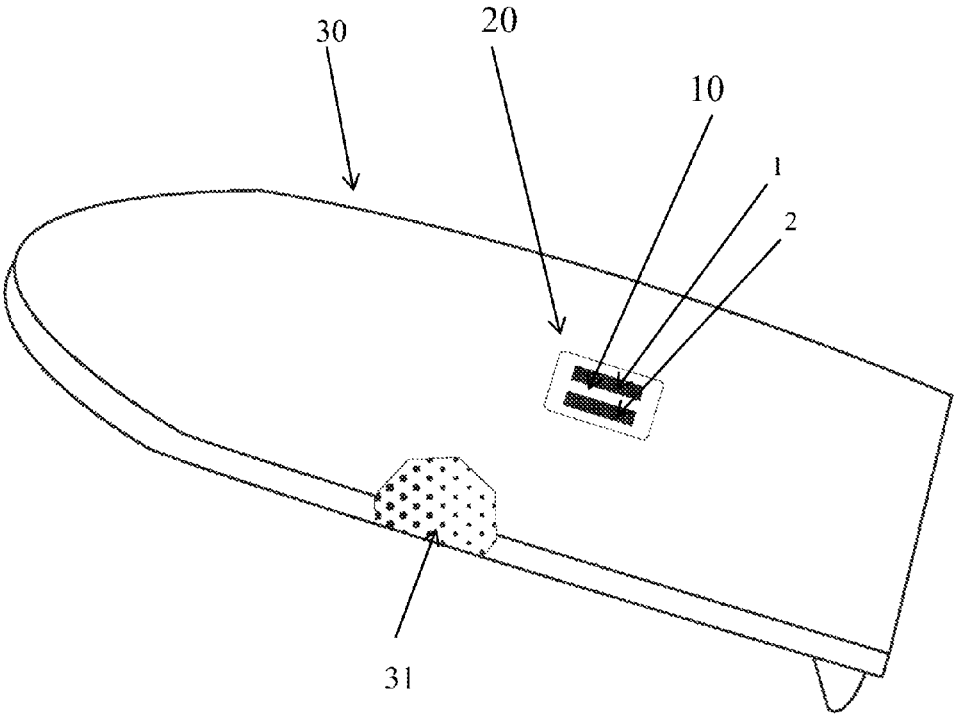
FIG. 1 is a perspective view of the grip handle structure mounted flush on a stand up paddle board at the center of gravity of the board.

Referring now to the drawings in which like numbers represent like elements in the several views provided, and in particular, referring to FIG. 1 a perspective view of the grip handle structure 20 is shown mounted flush into the paddle board 30 at the center of gravity of the board to provide the proper balance when the board is carried using the grip handle structure 20. The grip handle structure 20 is comprised of an elongated solid center grip handle 10 with two openings of the same length as the center grip handle 10 one on each side of the center grip handle 10. The two openings referred herein as void 1 and void 2 are used to insert the fingers of a user's hand through either side of the grip handle structure 20 so that the fingers and palms of the hand can be wrapped around the center grip handle 10 for a secure and comfortable hold to lift and transport the paddle board 30. In this perspective view of the paddle board 30 with the mounted grip handle structure 20 a section of the interior 31 of the board is shown to illustrate that the board 30 is constructed from a buoyant material such as polystyrene foam, or other similar buoyant material. The buoyant polystyrene or other material from which the stand up paddle board or other board is carved out is covered with fiber glass and epoxy resin and generally overlaid with fabric to impart strength, sturdiness and comfort to the paddle board 30. An additional advantage of the grip handle structure 20 is that a cable can be inserted through the voids 1 and 2 and wrapped around the center grip handle 10 and the paddle board locked up and secured using a cable lock when not in use.

Figure 2:
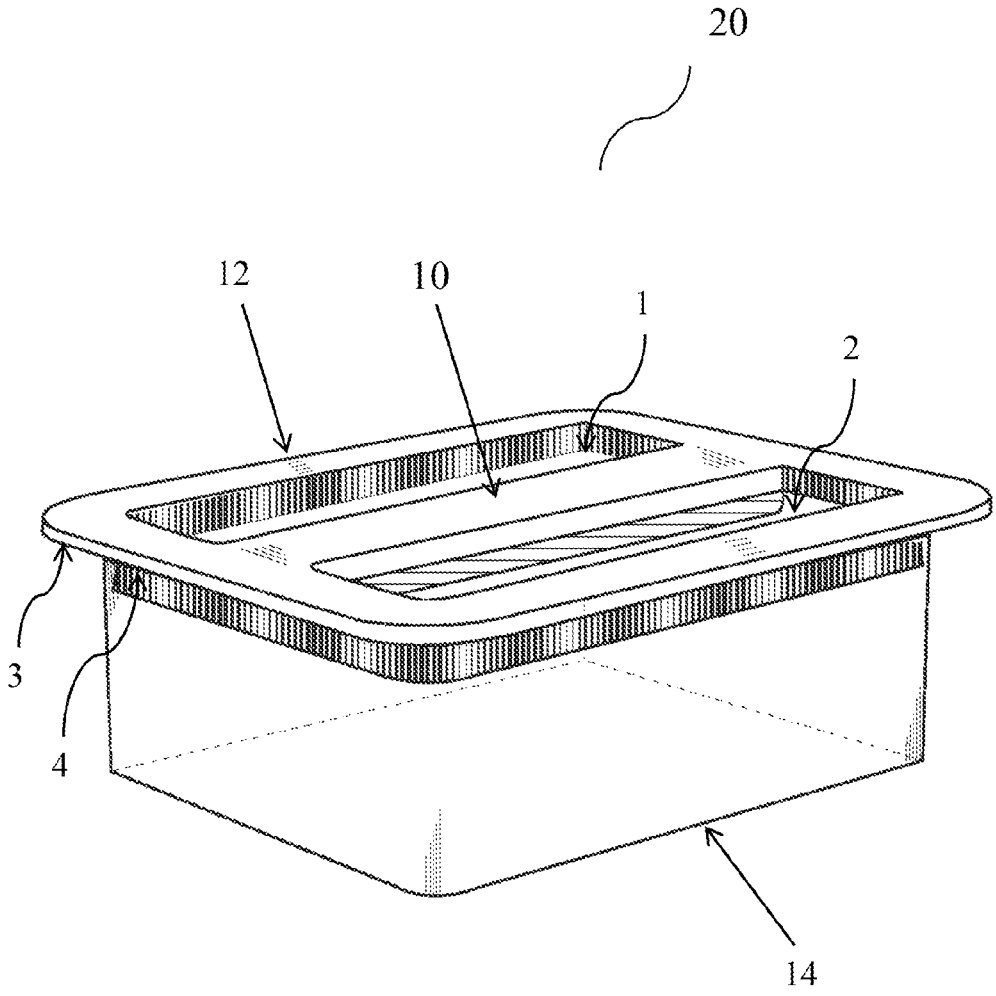
FIG. 2 is a perspective view of the grip handle structure of the present invention before it is installed within a stand up paddle board or other water craft board.

Referring now to FIG. 2 a perspective view of the grip handle structure 20 of the present invention is shown outside the confines of the paddle board or other water craft boards. The top handle part 12 is comprised of a solid elongated center grip handle 10 with two openings, void 1 and void 2 on either side of the solid center grip handle 10. The center grip handle 10 has an approximate width of 2 cm which makes it more ergonomic and easier for the fingers of a hand to wrap around it. The design of the top part 12 with the elongated center grip handle 10 and the two voids 1 and 2 are created using a high strength injection molding process to assure a sturdy handle structure that can withstand the weight of the board when carried, without breaking apart. The top handle part 12 is further strengthened by extending its flange 3 by 1.3 cm past the bottom box part 14. The bottom of the top handle part 12 has an extension 4 downward of approximately 1.75 cm that slides and locks into the top of the bottom box part 14 and the two parts are glued together with watertight epoxy resin adhesive prior to installation into the body of the paddle board or other water craft. The two parts glued together have an approximate measurement of 11 cm in length 9 cm in width to form the grip handle structure 20.

Figure 3:
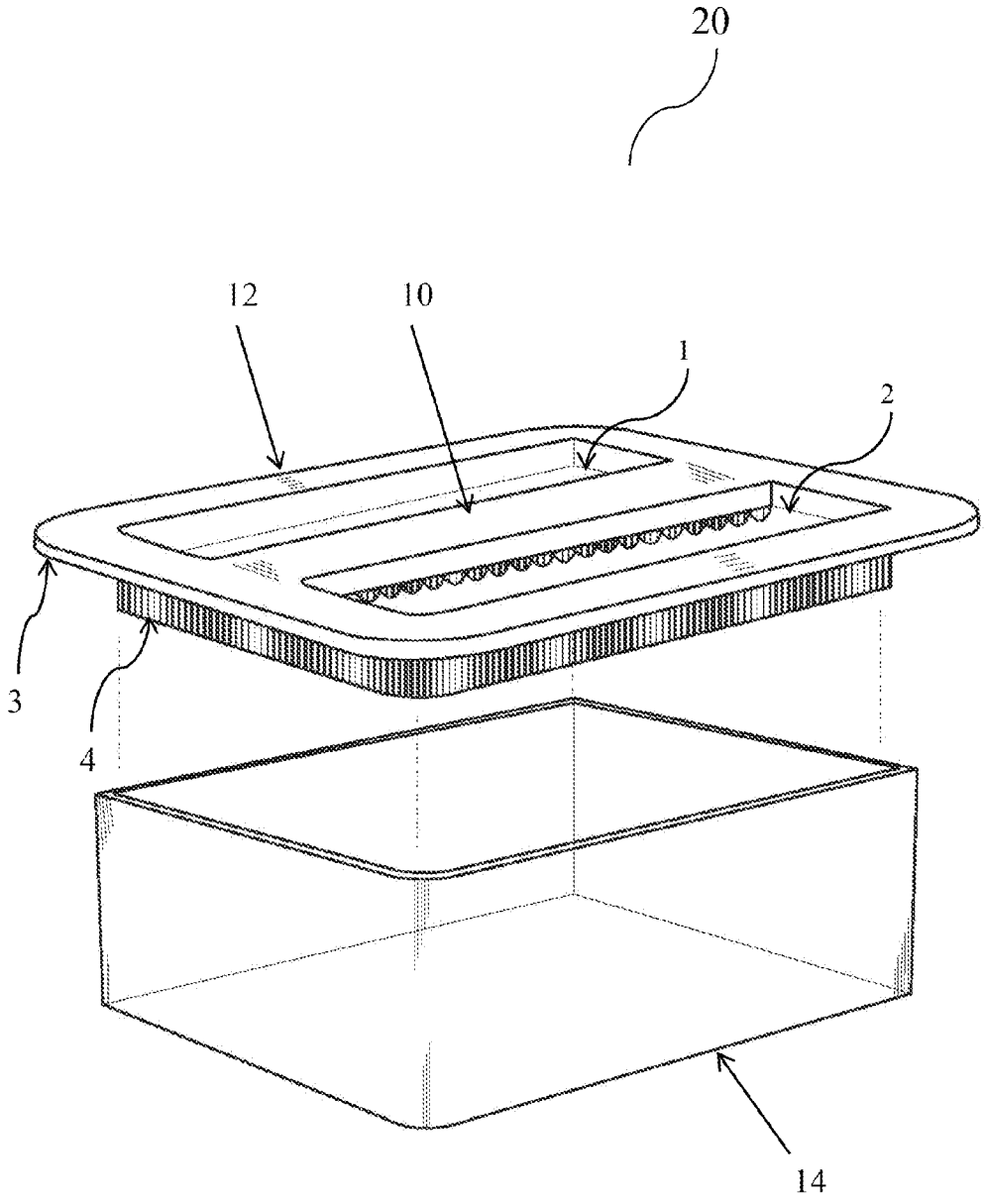
FIG. 3 is a perspective view of the top and bottom parts of the grip handle structure before they are glued together to form the complete structure.

FIG. 3 shows a perspective view of the top handle part 12 and the bottom box part 14 before they are glued together. The extended bottom 4 of the top handle part 12 is aligned to fit inside the top end of the bottom box part 14 and glued together using a suitable glue such as a watertight epoxy resin adhesive that will hold the two parts together permanently without them coming apart.

Figure 4:
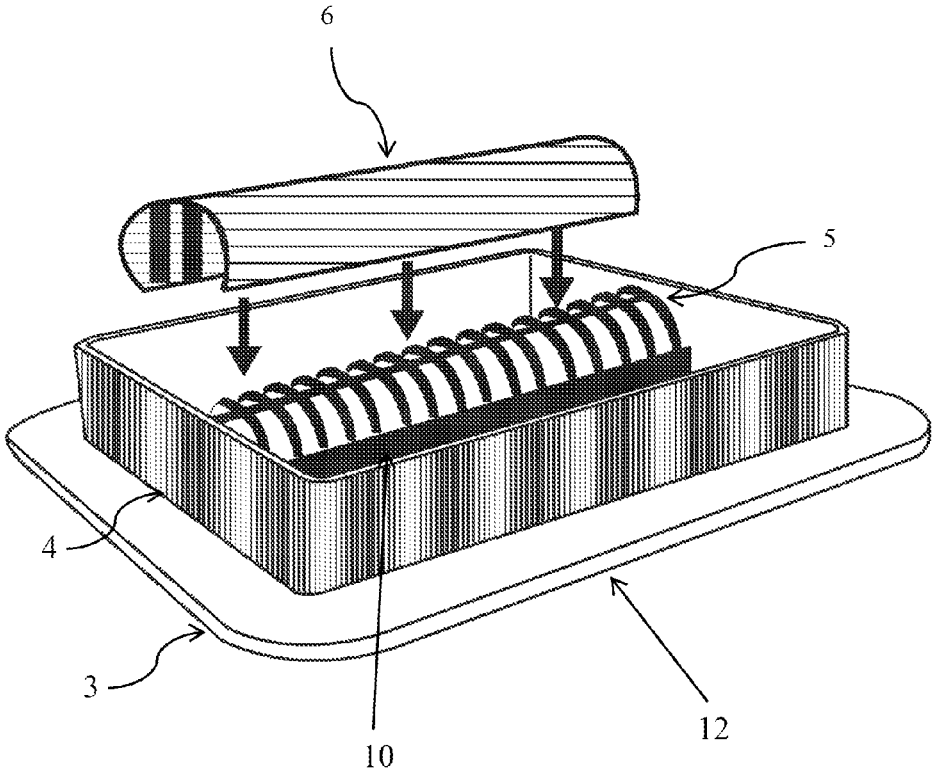
FIG. 4 is a perspective view of the top handle part of the grip handle structure in an inverted position showing the placement of the molded rubber insert over the bottom grill of the center grip handle.

FIG. 4 is a perspective view of the top handle part 12 in an inverted position showing the grill type structural configuration on the underside of the grip handle 10. A molded rubber insert 6 covers the grill 5 of the grip handle 10 to make gripping the handle and carrying the board comfortable. The other advantage in having the molded rubber insert 6 over the grilled underside 5 of the grip handle 10 is that it provides the grip handle 10 more traction when the fingers are wrapped around it and makes it less slippery when wet.

Figure 5:
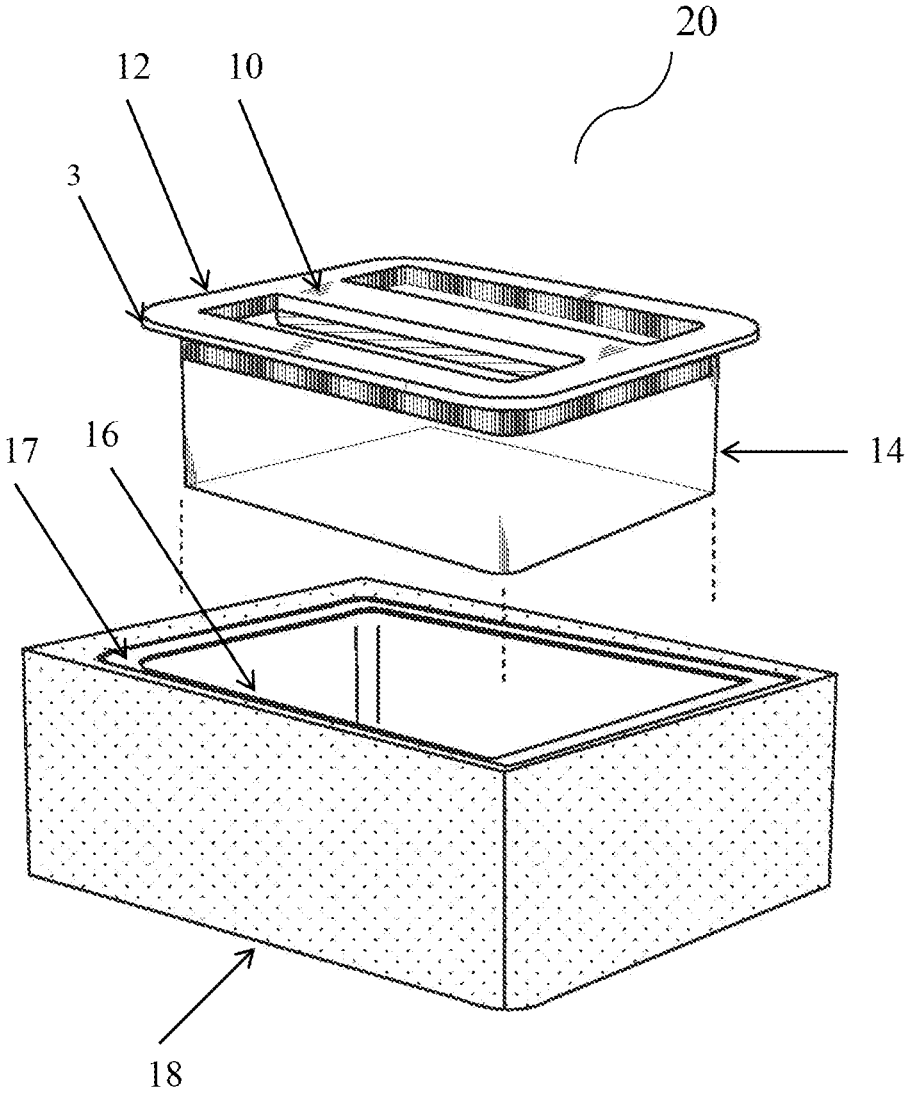
FIG. 5 is a perspective view of the manner in which the grip handle structure is installed into the foam core of the paddle board.

FIG. 5 illustrates the process involved in installing the grip handle structure 20 into the foam core 18 of the standup paddle board or other water craft. A two part router jig is used to carve out the shape of the center hole or box 16 within the foam core 18 of the paddle board to accommodate the grip handle structure 20. A shallower groove 17 is carved out around the perimeter of the box 16 to house the extended flange 3 of the top handle part 12. The extended flange 3 on the top handle part 12 helps in strengthening the top handle part 12 and provides a stronger and tighter fitting installation of the grip handle structure 20 flush into the foam core 18 of the standup paddle board or other board resulting in no parts protruding out of the surface of the board. After the grip handle structure 20 is placed flush into the cavity of the routed box 16 of the foam core 18 of the board, epoxy resin is used to glue the grip handle structure 20 to the foam core 18 and thus to the paddle board. The ergonomic design of the grip handle structure 20 of the present invention makes it possible for it to be integrated into even hollow construction water craft using any surface mounted application where the extended flange 3 sits on top of the surface skin of the craft.

Figure 6:
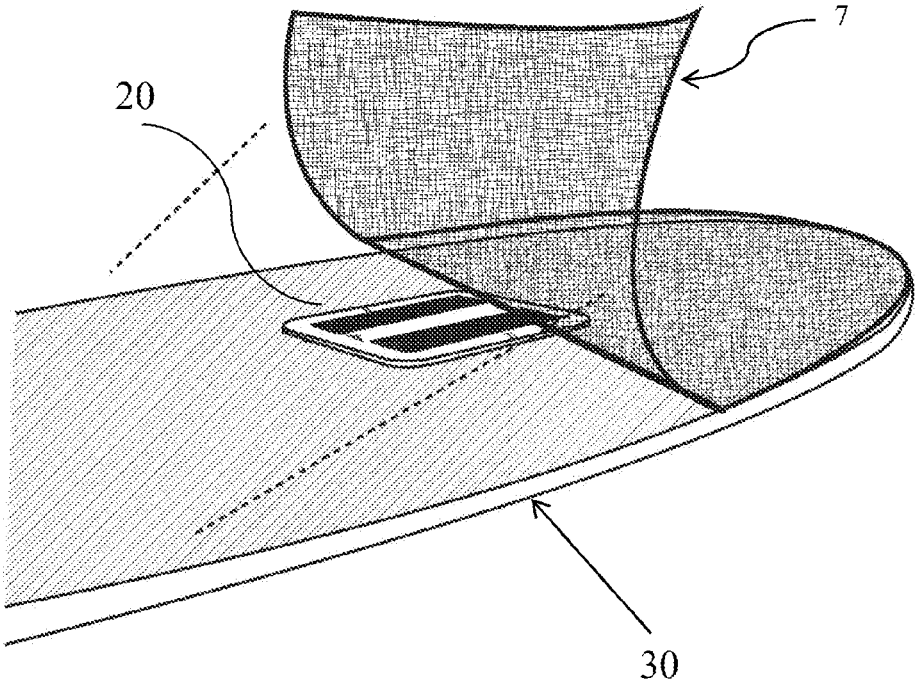
FIG. 6 is a perspective view illustrating the grip handle structure being covered by a fiber re-enforced resin after the handle is installed flush within the paddle board.

FIG. 6 is a perspective view illustrating the application of a fiber re-enforced resin 7 over the board including the grip handle structure 20. As the resin 7 cures, the two hollow sections on either side of the center grip handle are cut out to create the openings/voids through the fiber-re-enforced resin 7. The final step is to cover the board including the grip handle structure 20 with a padded material to provide more comfort when gripping the handle. After the padded material is glued on, the voids on either side of the center solid grip handle are again cut out and opened up using a razor or a sharp knife.

Figure 7:
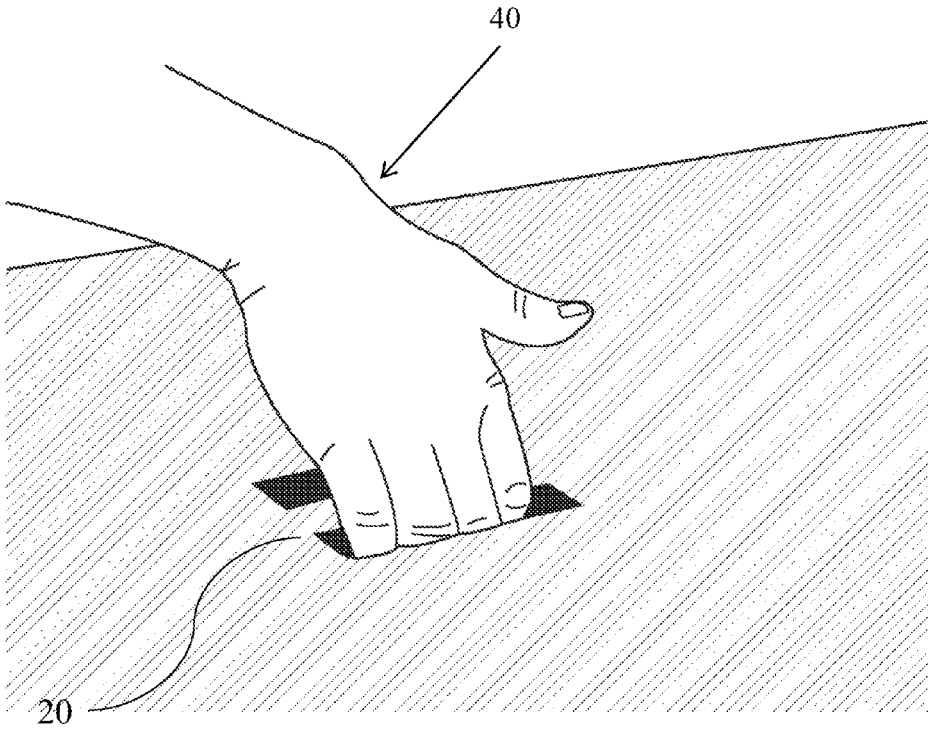
FIG. 7 is a perspective view of the manner in which the fingers of a hand are inserted into the grip handle structure to carry the paddle board.

FIG. 7 is a perspective view of the manner in which the fingers of a hand 40 are inserted into the voids of the grip handle structure 20 to carry the paddle board. The ergonomic design of the grip handle structure 20 makes it easy to slip the fingers through the voids on either side of the solid center grip handle and the molded rubber insert at the bottom of the center grip handle provides a comfortable and secure grip and prevents it from slipping from the hand even when the handle is wet.

Figure 8:
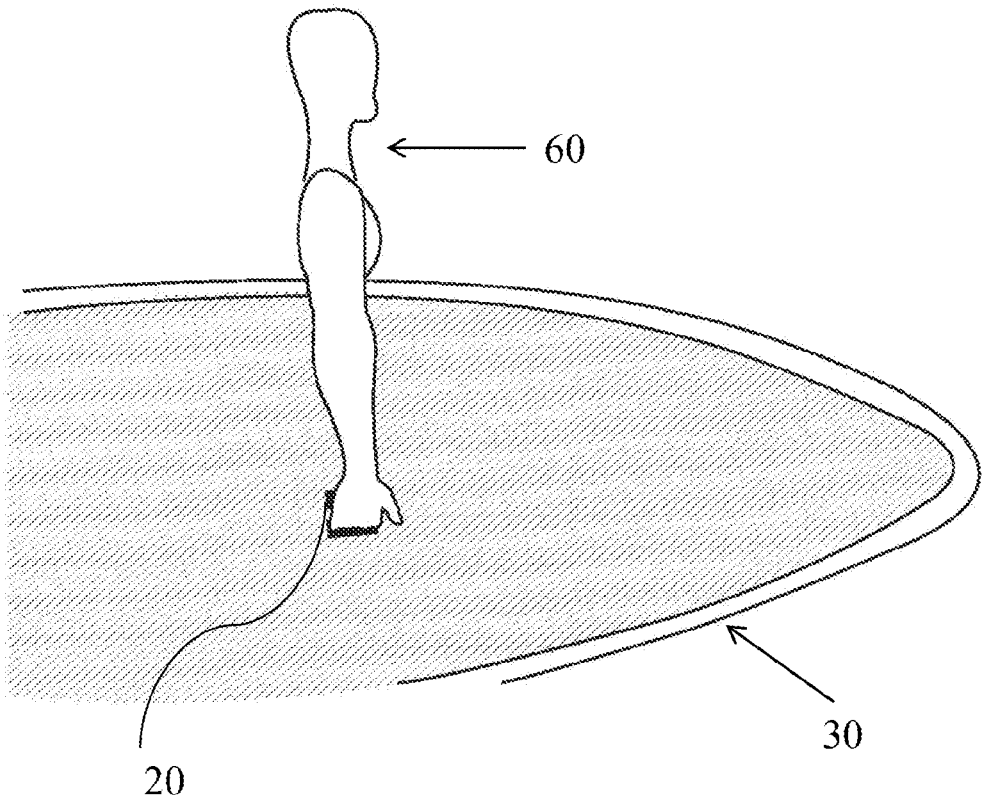
FIG. 8 is a perspective view of a user carrying a paddle board by means of the grip handle structure of the present invention.

FIG. 8 is a perspective view of a user 60 carrying the paddle board 30 using the grip handle structure 20 of the present invention. Since the grip handle structure 20 is installed and mounted flush into the paddle board 30 at the center of gravity of the board, holding the paddle board 30 using the grip handle structure 20 provides the proper balance for transporting the paddle board in a comfortable and secure manner.

The foregoing detailed description of the present invention through its figures and exemplary embodiment should not be construed to limit the scope of the invention. It should be understood that the phraseology and terminology used to describe the various parts of the invention are for descriptive purposes only and other phrases and terminology may be used to describe the relevant parts of the invention without departing from the scope of the invention. It should be further understood and obvious to those skilled in the art that alternatives, modifications and variations of the embodiment of the invention described herein are within the spirit and scope of the appended claims.

What is claimed is:

1. A grip handle for a water craft board, said grip handle comprising:

a top handle structure member;

a bottom box structure member;

said top handle structure member having an extension at a bottom end to lock into a top part of said bottom box structure member;

said top handle structure member glued to the top part of said bottom box structure member through the bottom end of said top handle structure member;

said top handle structure member comprising an elongated solid center grip handle structure member and two voids on either side of said elongated solid center grip handle structure member;

said two voids on either side of said elongated solid center grip handle structure member having the same length as said elongated solid center grip handle structure member;

said elongated solid center grip handle structure member having a grill at a bottom surface for gripping said elongated solid center grip handle structure member;

said grill at the bottom surface of said elongated solid center grip handle structure member covered with molded rubber;

said top handle structure member having an extended flange to strengthen said top handle structure member and facilitate mounting said grip handle flush with a body of said water craft board; and said two voids on either side of said elongated solid center grip handle structure member adapted to be used for inserting the fingers of a hand into them and to wrap said fingers around the said elongated solid center grip handle structure member to hold the said water craft board.

2. The grip handle as described in claim 1 wherein the water craft board is one of a stand up paddle board, sit on top kayak, small sail boat, windsurf board, balance training board, and other water craft boards that are too wide to be carried under the arm.

3. The grip handle as described in claim 1 wherein the top handle structure member is glued to the top part of the bottom box structure member through the bottom end of the top handle structure member using a watertight epoxy resin adhesive that will hold the two parts together permanently without them coming apart.

4. The grip handle as described in claim 1 wherein the grip handle structure is placed flush into a cavity of a routed box formed from a foam core of the water craft board and glued to said foam core of said water craft board using an epoxy resin glue.

5. The grip handle as described in claim 1 wherein the grip handle is installed flush at the center of gravity of the water craft board to provide the proper balance when the water craft board is carried using the grip handle.

6. The grip handle as described in claim 1 wherein a fiber re-enforced resin is applied over the grip handle after it is installed into the water craft board to further strengthen the installation of the grip handle into the board.

7. The grip handle as described in claim 6 wherein an additional padded material may be applied over the fiber re-enforced resin to provide comfort when holding the grip handle.

8. The grip handle as described in claim 1 wherein the molded rubber placed over the grill on the bottom surface provides comfort to the hand when gripping the handle and prevents the handle from slipping even when it is wet.

9. The grip handle as described in claim 1 wherein a locking cable can be inserted through the voids on the grip handle to lock and secure the board when not in use.

10. The grip handle as described in claim 1 wherein the water craft board is one of a surf board and body board, where the extended flange on the top handle structure member sits on top of the board.

11. The grip handle as described in claim 1 wherein the grip handle can be integrated into both wide bodied and narrow bodied water craft boards.

* * * * *